United States Patent [19]

Harriman et al.

[11] Patent Number: 4,679,989

[45] Date of Patent: Jul. 14, 1987

[54] PUMP SHOVEL BULK UNLOADER

[75] Inventors: Charles E. Harriman, Bloomingdale; Donald S. Nii, Arlington Heights, both of Ill.

[73] Assignee: Graco Inc., Minneapolis, Minn.

[21] Appl. No.: 887,023

[22] Filed: Jul. 16, 1986

[51] Int. Cl.[4] ..... F04B 7/04

[52] U.S. Cl. ..... 417/238; 417/403; 417/489; 417/552; 92/13.41

[58] Field of Search ..... 417/238, 403, 404, 489, 417/552, 900; 92/13.3, 13.4, 13.41, 13.51

[56] References Cited

U.S. PATENT DOCUMENTS

| | | | |
|---|---|---|---|
| 2,294,705 | 9/1942 | Wedeberg | 417/489 X |
| 2,787,225 | 4/1957 | Rotter | 417/489 X |
| 3,295,453 | 1/1967 | Scott | 417/552 X |
| 4,035,109 | 7/1977 | Drath et al. | 417/489 X |
| 4,047,854 | 9/1977 | Penn | 417/489 |

*Primary Examiner*—Leonard E. Smith

*Attorney, Agent, or Firm*—Douglas B. Farrow

[57] ABSTRACT

An air-operated reciprocating pump is designed for use with a wide variety of materials having widely varying viscosities. The pump has a stroke which is adjustable so that the piston can operate either entirely within the cylinder or can extend out the bottom end of the cylinder at the end of the stroke for materials having an extremely high viscosity. The stroke adjustment is easily accessible in the area between the pump and the air motor.

7 Claims, 2 Drawing Figures

PUMP SHOVEL BULK UNLOADER

BACKGROUND OF THE INVENTION

Air-operated reciprocating pumps are in general well known and have been used for many years with a variety of materials. In such pumps typically, a piston reciprocates within a cylinder to pump the fluid which is loaded into the cylinder through a check valve located in the piston. When it has been desired to utilize such types of pumps for highly viscous materials, a so called shovel pump arrangement has been used wherein the piston at the bottom end of its stroke extends beyond the open bottom end of the cylinder to allow material to be taken into the cylinder. While such pumps are each effective with respect to the types of materials for which they are designed, heretofore such pumps have not been easily adapted between types of materials without replacing the whole pump lower assembly. It is, therefore, an object of this invention to provide a pump which may be easily and quickly adapted to pump a variety of materials having widely varying viscosities.

SUMMARY OF THE INVENTION

A fairly typical air-operated reciprocating pump is provided with a connecting rod which has a piston attached at the end thereof. The piston has a plate-check valve associated with it and for purposes of normal operation, the piston stroke is retained entirely within the cylinder formed by the outlet housing. When it is desired to pump materials of a particularly viscous nature, an adjustment is made between the main connecting rod and the lower connecting rod, such that the lower end of the piston stroke extends the piston beyond the bottom edge of the cylinder, thereby providing a shovel-type loading for the pump. This adjustability assures that the pump can be usable with a wide variety of materials by making only a simple adjustment which does not require any substantial disassembly in order to do so. The main connecting rod and the lower connecting rod are threadedly attached to one another and have a plurality of sets of holes to positively locate the two relative to one another. A cotter pin or other elongated piece may be used to additionally secure the two in the desired position.

These and other objects and advantages of my invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
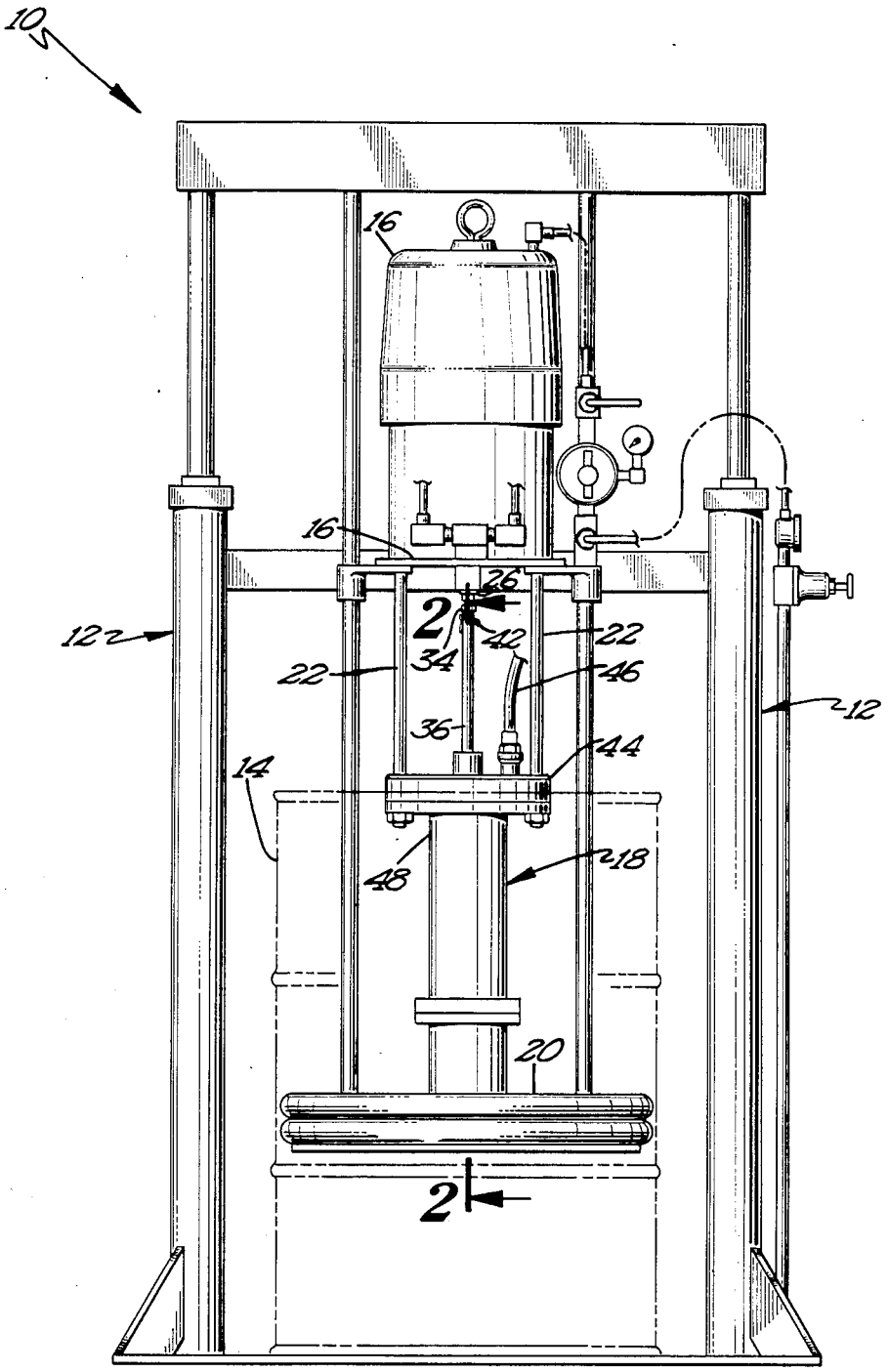
FIG. 1 is a side-plan view showing the instant invention.

Referring generally to FIG. 1, the instant invention, generally designated 10 is utilized with a hydraulic ram 12 which may be utilized for pumping material out of a barrel 14 located thereunder. Mounted on the ram 12 is an air motor 16 which produces a reciprocating output in response to an input of pressurized air. Such air motors are in general well known and further detail will not be lavished on such except as is particularly applicable to the instant invention.

Located beneath air motor 16 is pump lower 18. Attached to the bottom end of pump lower 18 is ram plate 20 which has a seal about the outside for sealing engagement with the interior of barrel 14. A plurality of tie rods 22 serve to tie it together and secure air motor 16 and pump lower 18. This can be seen in more detail in FIG. 2.

Air motor output shaft 24 extends downwardly from air motor 16 and terminates in a threaded portion which is attached by a connecting nut 26 to a coupling connecting rod 28. A connecting rod 32 is secured to coupling connecting rod 28 by means of a cotter pin 30 or a similar fastening device. Connecting rod 32 is threadably engaged at threaded portion 32*a* to a threaded interior of lower connecting rod 36. A lock nut 34 is one means which is used to secure connecting rod 32 relative to lower connecting rod 36. Also, a series of cross-bores 38 are located in lower portion 32*a* of connecting rod 32 and can be used to position connecting rod 32 relative to lower connecting rod 36 in conjunction with cross-bore 40 in lower connecting rod 36 and cotter pin 42 threaded therethrough.

Figure 2:
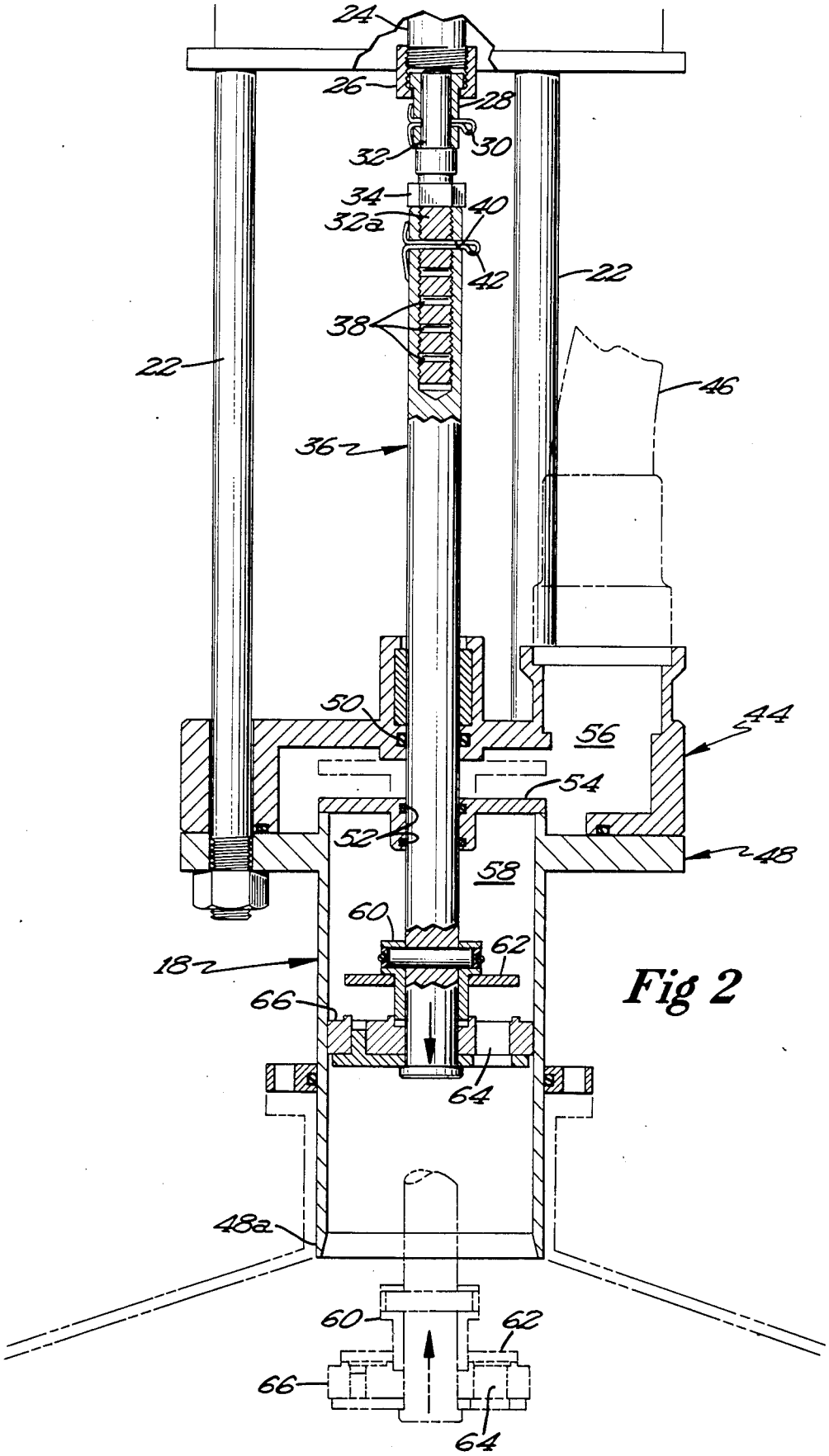
FIG. 2 is a sectional view taken along line 2—2 of FIG. 1.

Also shown in general view in FIG. 2 is an outlet housing 44 which may be of a cast or similar construction. Outlet housing 44 has an outlet hose 46 through which the pressurized material is pumped for use. Attached to the lower end of outlet housing 44 by tie rods 22 is intake housing 48. A seal 50 is provided in outlet housing 44 for sealing against lower connecting rod 36. Similarly, a plate valve 54 is slideably located via seals 52 about lower connecting rod 36. An outlet chamber 56 is formed in outlet housing 44 while similarly, a piston chamber 58 is formed below plate valve 54. A retainer 60 is attached to lower connecting rod 36 for slideably retaining plate check 32 which may slideably alternate between the position shown in solid and phantom in FIG. 2. A passage 64 is provided in priming piston 66 which may be alternately covered and uncovered by plate check 62.

In operation, the instant invention 10 may be operated generally in one of two modes. In the first mode for materials which are relatively less viscous, the lower connecting rod 36 is adjusted relative to upper connecting rod 32 such that at the lower end of its stroke, priming piston 66 remains within intake housing 48 and above the bottom edge 48*a* of intake housing 48.

Thus, in operation, as lower connecting rod 36 moves downwardly is shown in solid in FIG. 2, plate check 62 moves upwardly against retainer 60 and material to be pumped passes through passage 64 into chamber 58. At that point, lower connecting rod 36 reverses and moves upwardly thereby forcing plate check 62 downwardly against piston 66 and causing plate valve 54 to move upwardly into the position shown in phantom in FIG. 2, thereby pumping the material in chamber 58 into outlet chamber 56 and thence outwardly through outlet hose 46. At the end of the upward stroke, the cycle is then reversed and repeated.

For particularly viscous materials, lower connecting rod 36 is adjusted relative to connecting rod 32 such that the bottom end of its stroke, piston 66 is in the position shown in phantom in FIG. 2. Highly viscous materials generally need more area for loading the pump than provided by a passage such as that shown in 64. Thus, by extending 66 beyond the bottom edge 48*a* of intake housing 48, proper loading and operation with highly viscous materials may be accomplished.

It is contemplated that various changes and modifications may be made to the pump without departing from the spirit and scope of the invention as defined by the following claims.

What is claimed is:

1. A pump for pressurizing and transporting materials of varying viscosity, said pump comprising:

a cylinder having an open bottom end;

a piston reciprocally located in said cylinder and having top and bottom surfaces;

a reciprocating source of power;

a connecting rod connecting said piston and said power source, said piston oscillating between top and bottom positions; and means for adjusting the bottom position of said piston between a first position wherein said piston is located in said cylinder and a second position wherein said piston extends outside said open bottom end.

2. The pump of claim 1 wherein said adjusting means adjusts said bottom position in discrete steps.

3. The pump of claim 2 wherein said adjusting means comprises: at least one hole in said connecting rod at least one hole in said power source and means for locating said holes in contiguous relationship.

4. The pump of claim 1 further comprising a check valve associated with said piston.

5. The pump of claim 4 said check valve comprising a passage in said piston connecting said surfaces and a plate check slideably mounted on said connecting rod to selectively cover said passage.

6. The pump of claim 5 wherein said plate check releasably contacts said piston top surface.

7. The pump of claim 1 wherein said power source is an air motor.

* * * * *